United States Patent [19]

Barron

[11] 4,426,905

[45] Jan. 24, 1984

[54] PIANOHARP ACTION

[76] Inventor: Ellis Barron, 7228 Eads Ave., La Jolla, Calif. 92037

[21] Appl. No.: 421,974

[22] Filed: Sep. 23, 1982

[51] Int. Cl.[3] ..... G10D 3/16

[52] U.S. Cl. ..... 84/258; 84/320

[58] Field of Search ..... 84/258, 320, 321

[56] References Cited

U.S. PATENT DOCUMENTS

| | | | |
|---|---|---|---|
| 1,374,979 | 4/1921 | Bingaman | 84/258 |
| 3,478,630 | 11/1969 | Cucchiara | 84/258 |
| 4,099,440 | 7/1978 | Barron | 84/258 |
| 4,285,261 | 8/1981 | Barron | 84/258 |

*Primary Examiner*—Lawrence R. Franklin

[57] ABSTRACT

An improvement in the action for a harpsichord type of keyboard musical instrument which uses a pneumatic piston to provide a variable pluck loudness. The improvement comprises a new pick-body design which allows several strings to be plucked at once for any single note or key, thus increasing the loudness of the instrument. The invention involves the use of a crank arm which, being restrained by a pneumatic piston, tilts the pick-body and the picks into the strings, the loudness resulting therefrom being proportional to the key-lever velocity.

2 Claims, 4 Drawing Figures

PIANOHARP ACTION

BACKGROUND OF THE INVENTION

This invention relates to keyboard musical instruments of the harpsichord type where the tone is produced by plucking a musical string. In particular it relates to such instruments where the strength of the pluck can be varied by the force exerted at the keyboard, that is, the so-called "piano-forte" effect. In a previous patent (U.S. Pat. No. 4,285,261) I disclosed a pneumatic piston action for such an instrument which carried a single pick for plucking a single string for each key. Because of the design and the space requirements of that action, it was impossible to add extra picks or extra strings for each key to increase the loudness of the instrument. In the present disclosure I describe an action which overcomes these limitations and which enables the instrument to approach the loudness of the modern piano.

SUMMARY OF THE INVENTION

In my new action, I have positioned the extra strings for any single note or key in a vertical row above the corresponding key-lever, each string being placed a small distance above the other. The picks for these strings, one for each string, are mounted on a pick-body and spaced the same as the strings, such that in the rest position they are below and to the side of the strings. The pick-body carries a crank which allows it to tilt into the strings when driven by the key-lever during the pluck stroke. One arm of the crank slides in a vertical slot which is fixed in relation to the strings and the other arm is restrained by the pneumatic piston such that the amount of tilt and thus the loudness of the pluck is proportional to the velocity of the key-stroke.

DETAILED DESCRIPTION OF THE INVENTION

Figure 1:
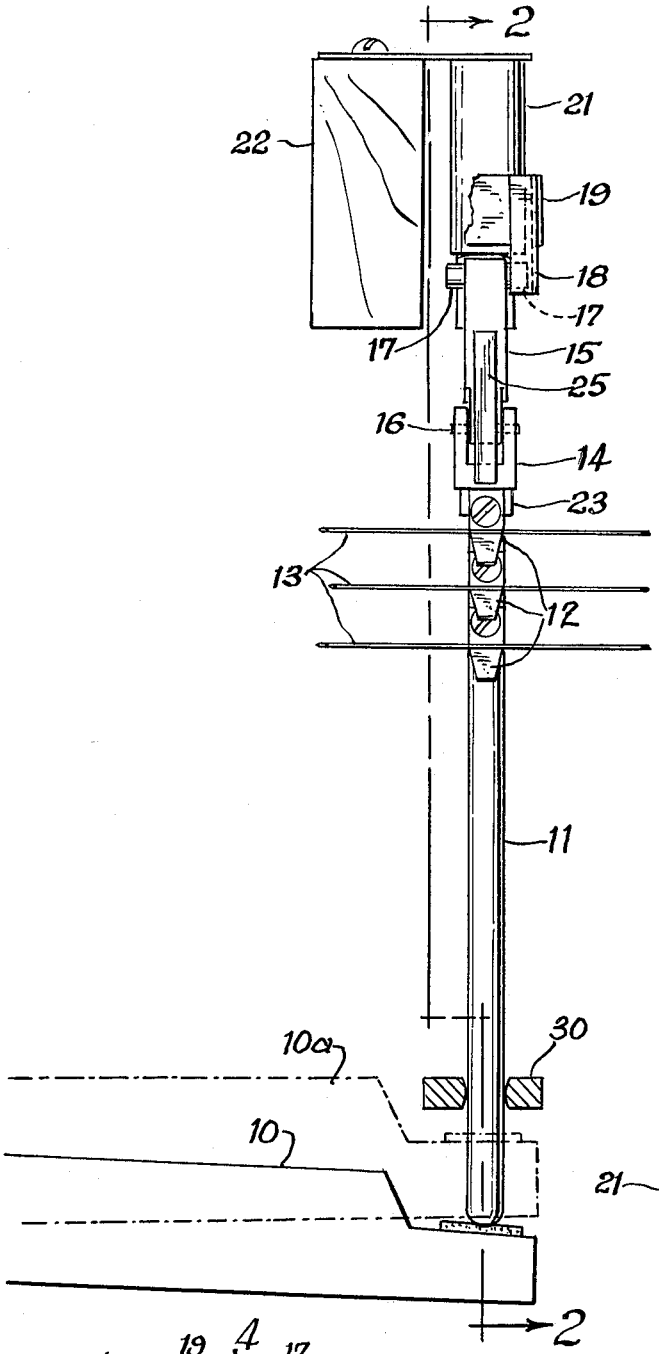
FIG. 1 is a side elevational view of my new action for one key or note of the instrument. The action is shown in the rest position as seen from the side of the instrument and the player, were he to be shown, would be situated to the left in the figure. I show only the rearward end of the key-lever, that is the end opposite the player which rises as the instrument is played. As horizontal lines I show, as a preferred embodiment, a set of three strings for the single key-lever, with the face of three corresponding picks also shown. The raised position of the key-lever is shown as a phantom line, it being understood that the picks and the rest of the action are raised similarly during the pluck stroke. Shown above the strings is the crank and crank pin, a portion of the guide slot being cut away to show the pin more clearly. Also shown is the cylinder portion of the pneumatic piston, the former being mounted on a cross member shown in section.

Turning now to a more detailed description of my invention, I refer first to FIGS. 1 & 2 again, where I show as 10 the key-lever in the rest position and as 10*a* the key-lever at the end of the pluck stroke. I show as 11 the pick-body which works in the lower guide 30 and to which are attached the set of picks 12, for plucking the set of musical strings 13. I show the set of strings as being three in number, one above the other, it being understood that this number can be more or less than three. In a like manner, the number of picks would correspond thereto. I show as 14 the yoke fixed to the upper end of the pick-body 11 and carrying the crank 15 by means of pivot 16. Spring shelf 23 is also fixed to the pick-body 11 and carries spring 24 which bears on the underside of crank 15, forcing the crank stop extension 25 against the yoke 14 when the action is at rest. Crank pin 17 slides in the guide slot 18 made from two pieces of channel stock. Bracket 19 fixes these channels to the pneumatic cylinder 21. One channel of the guide slot 18 is cut away in these figures to show the crank pin 17 more clearly. Pneumatic piston 20 slides in cylinder 21, the latter attached to fixed cross member 22 which spans the entire instrument. Inside piston 20 is piston rod 26 which rests on the horizontal arm of crank 15 through felt pad 27.

Figure 2:
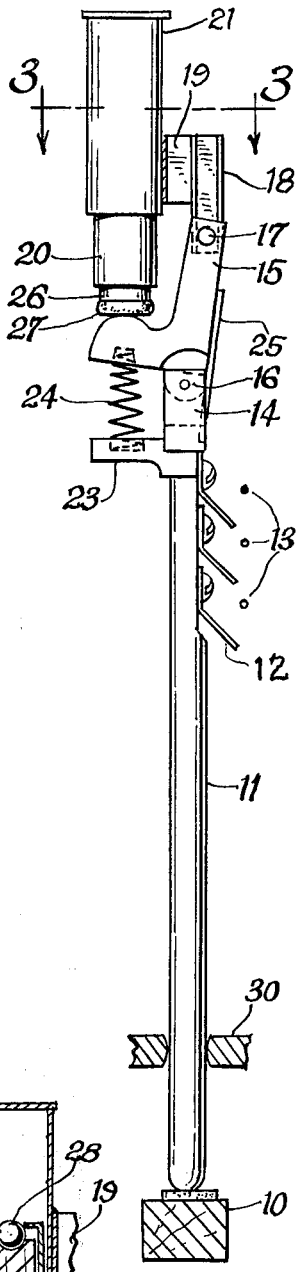
FIG. 2 is a front elevation of my action for one key as seen by the player seated at the instrument and is a view through the plane 2—2 of FIG. 1. The pivot, crank, and pneumatic piston are shown at the upper end of the pick-body and an edge view of the three picks is shown, these latter being mounted at a depending angle adjacent to the three musical strings.
Figure 3:
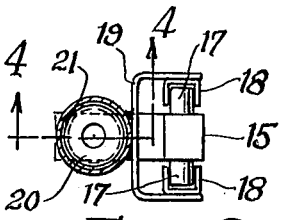
FIG. 3 is a partial top view of the action showing a bracket joining the two part guide slot to the pneumatic cylinder, the latter shown in section. The figure shows the crank pin riding in the guide slot, the slot formed by two facing U shaped channels.

Refering now to FIG. 3 taken through 3—3 of FIG. 2, I show a top section view of the pneumatic piston and cylinder with crank pin 17 enclosed in guide slot 18, the latter fixed to cylinder 21 with bracket 19 as described above.

Figure 4:
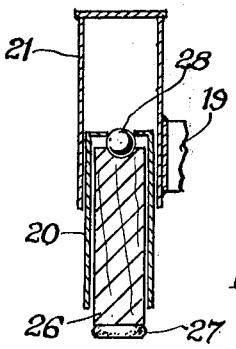
FIG. 4 is a section view of the pneumatic piston and cylinder taken through 4—4 of FIG. 3. It shows a simple embodiment of my unique pneumatic action wherein the piston is allowed a rapid recovery after the pluck stroke by the use of a ball valve, the valve being connected to the crank arm by means of a wooden dowel and felt pad.

Finally in FIG. 4 which is a section 4—4 of FIG. 3, I show the details of the pneumatic piston. Thus is shown ball 28 working in an aperture in the top of piston 20 and connecting through rod 26 and felt pad 27 to crank 15 as described above. I have shown rod 26 as a wooden dowel, this being a simple and convenient embodiment of this part. It is made slightly smaller than the piston inside diameter and thus is guided without other parts by the walls of the piston itself.

The parts of my new invention having now been described, the plucking action thereof can easily be understood as follows. If the player depresses the key-lever very slowly, pick-body 11 will rise accordingly and spring 24 and stop 25 will restrain any rotation of crank 15, and piston 20 will rise in the cylinder 21, the air trapped inside having enough time to escape between the walls thereof. Thus, in this case, there is little or no rotation of the crank 15, and the picks will not pluck the strings since their relation thereto is determined by pin 17 sliding in guide slot 18.

On the other hand, for the case where key-lever end 10 rises rapidly, that is, where the player is using great force at the key-board, it can be seen that there will be insufficient time for air to escape from the pneumatic cylinder 21 and crank 15 will be rotated maximumly; and because pin 17 is restrained from all but vertical motion in guide slot 18, pick-body 11, acting through pivot 16, will be tilted into the strings causing them to be plucked maximumly. Adjustments to the air escape rate and thus the amount of lateral pick-body tilt are made by altering the ball valve fit during the voicing of the instrument. Although the foregoing presents the preferred embodiment of my improved Pianoharp Action, I pray that my invention include such other embodiments or modifications thereof as would occur to those skilled in the subject art and as fall within the following claims.

I claim:

1. In a keyboard type of musical instrument having a set of one or more vibratable elements for each key-lever or note thereof, an improvement in the plucking means for each set of said elements comprising;

(a) a tiltable pick-body carrying at one end a set of picks for plucking said set of vibratable elements, and being driven at the opposite end by said key-lever;

(b) a crank having two arms at right angles and having a pivot, said pivot being carried by said pick-body;

(c) a pin fixed in one arm of said crank and sliding in a guide slot fixedly located in alignment with said vibratable elements;

(d) pneumatic piston means engaging the opposite arm of said crank and causing said pick-body to tilt into said vibratable elements during the pluck stroke; and (e) spring means engaged between said pick-body and said opposite arm of said crank so as to cause said picks to escape said vibratable elements upon release of said key-lever.

2. A plucking means according to claim 1 wherein said pneumatic piston has an aperture and a ball integral therewith to allow a rapid repeat action.

* * * * *